United States Patent [19]

Pozzo

[11] 4,300,340

[45] Nov. 17, 1981

[54] HOUSING FOR HOLDING A THREAD MONITOR COMPRISING A THREAD TENSION SENSOR

[75] Inventor: Hans Pozzo, Ingolstadt, Fed. Rep. of Germany

[73] Assignee: Schubert & Salzer, Ingolstadt, Fed. Rep. of Germany

[21] Appl. No.: 142,626

[22] Filed: Apr. 22, 1980

[30] Foreign Application Priority Data

Apr. 26, 1979 [DE] Fed. Rep. of Germany ... 7912192[U]

[51] Int. Cl.[3] ..... D01H 13/16

[52] U.S. Cl. ..... 57/80

[58] Field of Search ..... 57/78, 80, 81, 264; 73/160

[56] References Cited

U.S. PATENT DOCUMENTS

| | | | |
|---|---|---|---|
| 3,404,524 | 10/1968 | Rajnoha et al. | 57/81 |
| 3,676,990 | 7/1972 | Santerre et al. | 57/81 X |
| 4,075,445 | 2/1978 | Kempf | 57/81 X |
| 4,100,722 | 7/1978 | Suzuki et al. | 57/80 X |
| 4,112,661 | 9/1978 | Suzuki et al. | 57/80X |

*Primary Examiner*—Donald Watkins

*Attorney, Agent, or Firm*—Bailey, Dority & Flint

[57] ABSTRACT

A housing for holding a thread monitor of an openend spinning machine including a first attachment which secures a switching member to a cover and a second attachment for aligning the housing relative to the support cover. The support cover has recesses provided therein through which the first and second attachments extend for securing and aligning the housing relative to the support cover.

4 Claims, 2 Drawing Figures

HOUSING FOR HOLDING A THREAD MONITOR COMPRISING A THREAD TENSION SENSOR

BACKGROUND OF THE INVENTION

The present invention relates to a housing for holding a thread monitor comprising a thread tension sensor and a switching member for controlling a fiber feed device of an open-end spinning station.

In a known apparatus, in the cover of an open-end spinning station is provided a recess acting as a passage for the thread taken off from the spinning station (German Patent Application No. P 28 11 960.0-26, Schubert & Salzer prospectus "Rotor spinner RU 11/RU 80"). In the recess is located the thread tension sensor of a thread monitor which controls a fiber feed device for the spinning station in dependence upon thread tension. The thread monitor is attached to the cover directly or via a panel which forms the lid of a housing holding a spinning element. The fiber feed device may also be controlled by means of a push button which can be brought into action on the thread tension sensor and pivot the latter in the process. This push button is either supported by the thread monitor or attached to the cover independently of the thread monitor. Attachment of these parts is carried out by means of several screws. Assembly of the thread monitor is time-consuming as correct positioning of the thread monitor relative to the cover is difficult.

SUMMARY OF THE INVENTION

It is the object of the present invention to provide a housing which is functionally adapted to the cover. For this purpose, the cover and housing are to be coordinated with each other by their shape in such a way that assembly is facilitated.

This object is achieved according to the invention by the fact that the housing comprises a first attachment holding a switching member and a second attachment for aligning the housing relative to a support. Associated with with the two attachments are corresponding recesses in the support, so that the attachments act as an aligning device, preferably fixing the housing both with respect to position and orientation. Attachment of the housing directly or indirectly via a connecting piece hence provides the least difficulties and therefore proceeds rapidly.

To protect the thread sensor, the second attachment appropriately receives the thread tension sensor, wherefor it is advantageously constructed in the form of two parallel ribs between which is located the thread tension sensor arm.

A thread monitor design which is spatially particularly space-saving results if the thread tension sensor is rotatable about an axis. In order to limit the rotational impact of the thread tension sensor, the ribs advantageously project above the path of travel of the thread tension sensor and are disposed so closely to each other that they form path limiting stops for the thread tension sensor.

In order to simplify attachment of the housing to the support, the first attachment is constructed as a screw fitting for attachment of the housing to the support. Additional attachment is then no longer necessary.

The invention is explained in more detail below with the aid of drawings.

DESCRIPTION OF A PREFERRED EMBODIMENT

Figure 2:
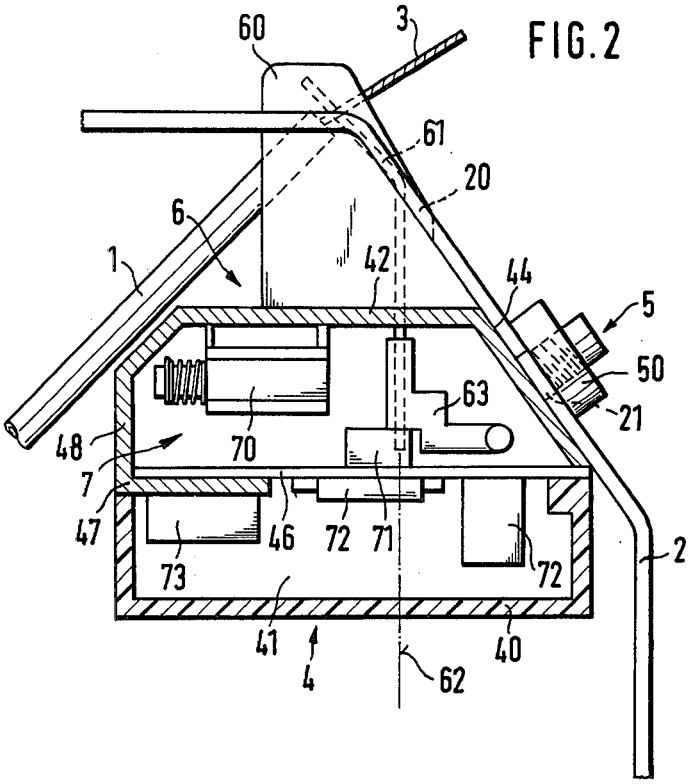
FIG. 2 shows a side view of the housing with a side wall removed.

The conventionally designed spinning station, of which only the upper opening of the thread outlet pipe 1 is shown in FIG. 2, is covered during production of thread 3 by a folding cover 2. The latter comprises a recess 20 through which extend two parallel spaced-apart ribs 60 which are disposed on both sides of the thread path and are closely surrounded by the side edges 22 of the recess 20.

The ribs are an integral part of a housing 4 which carries a switching member 5 which in a known manner serves to control a fiber feed device, not shown. The switching member 5 extends through an opening 21 in the housing 4, which is so small that it closely surrounds the switching member 5. In this way the recess 20 and the opening 21 fix the housing 4, so that the latter is perfectly adjusted both in position and in orientation. This is of substantial significance for perfect functioning of the thread monitor 6 carried in the housing 4, so that the thread tension forces necessary to actuate the thread monitor 6 also actually coincide with the forces calculated for actuation of the thread monitor 6. As a rule this is the case when the thread tension forces also actually act on the thread tensions sensor 61 in the direction provided.

Up to now, application of the housing 4 to the cover 2 has been relatively protracted as the threaded holes in the housing 4 and the corresponding holes in the cover 2 are relatively small and the surfaces of the housing 4 and cover 2 lie on top of each other without being able to fix a particular relative position. The ribs 60 and associated recess 20 in the cover 2 on the other hand have a relatively large surface area, so that the ribs can be introduced into the recess without difficulty. Attachment of the housing 4 to the cover 2 now poses no problems as the threaded holes in the housing 4 and holes in the cover 2 serving for attachment are now necessarily on top of each other on account of the attachments which effect adjustment and which are formed by the ribs 60 on the one hand and the switching member 5 on the other hand. Due to the provision of ribs 60 and the recess 20 coacting with them as well as the switching member 5 and opening 21 coacting with it, the housing 4 is functionally adapted to the support constructed as a cover 2.

In the embodiment described, the first attachment of the housing 4 is constructed in the form of two parallel ribs 60 between which is located the thread tension sensor 61. The thread tension sensor 61 is hence protected against external influences, so that undesired pivoting of the thread tension sensor 61 is excluded.

The thread tension sensor 61 is rotatable about a pivot axis 62 in the embodiment shown, wherein the thread tension sensor 61 crosses the direction of action of thread tension. Therefore, the pivot axis 62 is disposed in the vicinity of one rib 60, while the free end of the thread tension sensor 61 lies adjacent to the other rib 60 in the absence of thread tension. This other rib 60 thus acts as a path limiting stop.

To begin spinning, the thread tension sensor 61 is moved into the ready position wherein it lies adjacent to the rib 60 in the vicinity of which its pivot axis 62 is disposed, so that it frees the thread outlet pipe 1 and hence substantially facilitates introduction of the thread 3 into the thread outlet pipe 1. This rib 60 too thus acts as a path limiting stop.

When thread tension exists, the thread tension sensor 61 is located in its central position where it does not touch either of the two ribs 60.

In order for the ribs 60 to be able to act as path limiting stops, they project above the path of travel of the thread tension sensor 61 and are close together.

Since as a rule, apart from the guide in the housing 4, an additional guide is desirable for the switching member 5, in the embodiment shown in the illustrations the first attachment is formed by providing for the switching member 5 a screw fitting 50 which extends through the cover 2 and is constructed so strong that the housing 4 can be attached to the cover 2 by means of this screw fitting 50. In this way separate fastening by screws becomes superfluous, for which additional threaded holes in the housing 4 and holes in the cover 2 would have to be provided, so that by application of a screw fitting to the switching member 5, further functional adaptation of the housing 4 to the cover 2 takes place.

The subject of the invention was described above from the example of the housing 4 of a thread monitor 6 which is mounted on a cover 2 covering the spinning station. Instead of the cover 2 however, a different support may also be provided for the housing 4, according to how this is required by the construction of the spinning apparatus.

In the example illustrated with the aid of the drawings, the second attachment is formed by two parallel ribs 60 between which is located the thread tension sensor 61. Such an embodiment is of course particularly advantageous but it is also possible to construct the second attachment differently, e.g. in the form of a cylindrically or otherwise shaped projection.

In the interests of simple economical manufacture, the housing 4 advantageously consists of plastic. This as a rule does not cause any problems as the switching member 5 and thread monitor 6 do not become heated during operation thereof, so that no accumulation of heat occurs in the housing 4.

In the housing 4 however, there may also be disposed apart from the thread monitor 6 with the thread tension sensor 61 and switching member 5, for controlling the fiber feed device, not shown, a control device 7 with further electrical elements of which one or more generate heat to a particularly large extent. For instance a repelling magnet 70 is provided, which is approached by a magnetically controllable lug 63 of the thread tension sensor 61 when a thread breakage occurs. In the process, a contactless switch 71 is actuated which, immediately after a thread breakage occurs, pivots the thread tension sensor 61 until it lies adjacent to one of the ribs 60, in which position the thread tension sensor 61 releases the opening of the thread outlet pipe 1.

The repelling magnet 70, during its excitation, generates heat which heats the inner chamber of the housing 4 and may lead to damage to the repelling magnet 70 or other electrical elements 72 located in the housing 4.

Figure 1:
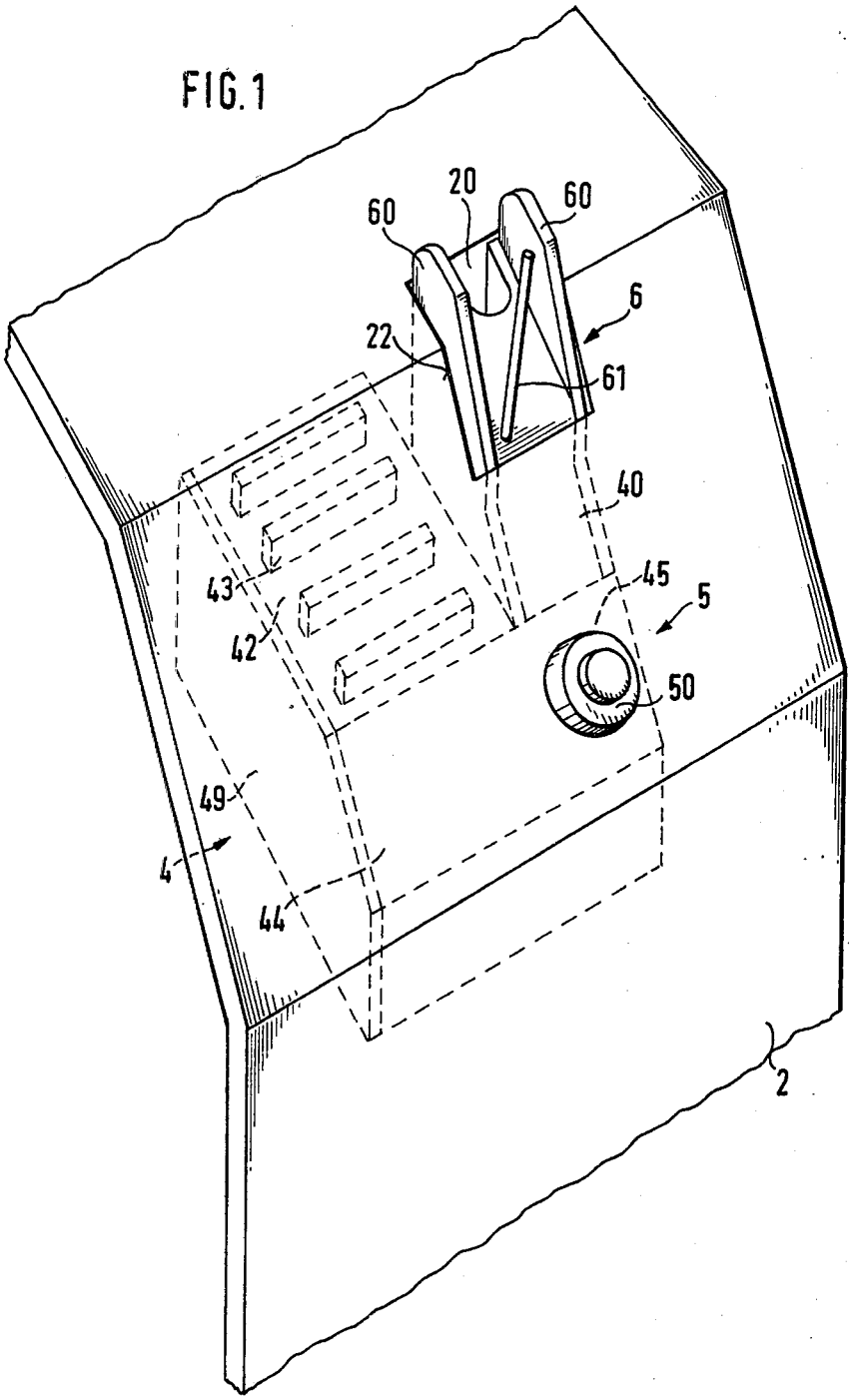
FIG. 1 shows a part of the cover with the housing constructed according to the invention.

In order to prevent damage to these parts, the housing consists of a plastic part 40 which contains an inner chamber 41 holding the control device 7, but has a metal support which is attached to this plastic part 40 and which supports at least the heat-generating elements of the control device 7 such as e.g. the repelling magnet 70. In the example shown, the metal support is formed by a metal lid 42, and is hence an integral part thereof. The heat which occurs is immediately released to the metal lid 42 which reflects the heat into the atmosphere surrounding it. To improve this reflective effect, the metal lid 42 according to FIG. 1 has lamellae 43 on the outside.

A further improvement in removal of heat is obtained if the support, for instance the cover 2, consists of metal and the metal lid 42 comprises a section 44 which lies adjacent to this support.

In order to render possible particularly good abutment of section 44 with the support consisting of metal, and particularly good removal of heat by the cover, the screw fitting 50 of the switching member 5 consists at least partially of metal, wherein this part of the screw fitting 50 consisting of metal is connected via a metal bridge 45 to the metal lid 42. The improved removal of heat takes place in this case due to the improved contact between the section 44 of the metal lid 42 and the support on the one hand, and between the part of the screw fitting 50 connected to the metal lid 42 and the support on the other hand. In this way too, functional adaptation of the housing 4 to the support is removed.

The control device 7 may however also comprise further heat-generating elements e.g. a thyristor 73 which, in the interests of a compact housing shape, may not be disposed in the same plane in the housing 4 as the repelling magnet 70 (see FIG. 2). The housing 4 comprises in this case an intermediate panel 46 which is appropriately constructed in the manner of a printed circuit and connects the electrical elements 72 and the thyristor 73 to each other electrically. Connected to the metal lid 42 is a fastening plate 47 for the thyristor 73 via a metal web 48, which, in the embodiment shown, is an integral part of the metal lid 42, but may also be detachable from the metal lid 42 and/or from the fastening plate 47. The heat generated by the thyristor 73 is therefore conducted away via the fastening plate 47 and metal web 48 to the metal lid 42 which, in the way which has already been described, releases the heat to the atmosphere or via the support to the other machine parts.

As the above description shows, the subject of the application can be modified in many ways. The two attachments serve to adjust the housing 4 and thus the thread tension sensor 61. If the switching member 5 at the same time comprises a screw fitting 50, this can also, besides as adjusting means, act as fastening means for the housing 4. Provision of the switching member 5 with a screw fitting 50 improves abutment of the housing 4 with the support. If the housing 4 is provided with a metal lid 42 and furthermore, if the support consists of metal, such a construction offers the possibility of particularly good removal of heat, although the actual housing 4 has a plastic part 40 containing the inner chamber 51. In all the cases described above, functional adaptation of the housing 4 to the support is obtained, which is constructed as a cover 2 for example.

According to a preferred embodiment of the subject according to the invention, the side wall 49 of the housing 4 is constructed as a metal lid, instead of or in addition to the metal lid 42. This side wall 49 too is in contact with the metal support carrying the heat-generating elements 70 and 73. This design also has the advantage that the air heated by reflection of heat on the outside of the side wall 49 rises, whereby, as a result of the movement of air and exchange of air, particularly good removal of heat is effected. This removal of heat may be further accelerated by the lamellae 43 being attached to this side wall 49.

While a preferred embodiment of the invention has been described using specific terms, such description is for illustrative purposes only, and it is to be understood that changes and variations may be made without departing from the spirit or scope of the following claims.

What is claimed is:

1. A housing for holding a thread monitor, said thread monitor including a thread tension sensor and a switching member for controlling a fiber feed device of a spinning station of an open-end spinning station, a switching member for operating said thread monitor, and a support cover extending over a thread outlet pipe of said spinning station, comprising:

an opening provided in said support cover;

attachment means carried by aid switching member for attaching said housing to said support cover;

a second attachment means carried by said housing and extending through said opening for aligning said housing relative to said support cover.

2. The housing as set forth in claim 1 further comprising:

said second attachment means including a pair of spaced parallel ribs (60) which project through said opening; and said thread tensioning sensor includes a sensing arm (61) which extends between said parallel spaced ribs.

3. The housing as set forth in claim 2 further comprising:

said thread tension sensor is a rotary sensor, operated by said sensing arm (61); and said ribs (60) project above said sensing arm (61) providing limiting stops for movement of said sensing arm.

4. The housing as set forth in claim 1 further comprising:

said attachment means is a screw fitting (50) attaching said housing to said support cover.

* * * * *